United States Patent [19]

Liebman

[11] 4,194,732

[45] Mar. 25, 1980

[54] CARDIAC PATIENT SUPPORT

[76] Inventor: Arno J. Liebman, 1819 Shore Dr., Apt. 218, South Pasadena, Fla. 33707

[21] Appl. No.: 921,894

[22] Filed: Jul. 5, 1978

[51] Int. Cl.[2] ..... A61H 31/00

[52] U.S. Cl. ..... 269/323; 269/328

[58] Field of Search ..... 269/322–328, 269/235; 128/28, 33, 70, 74; 5/327 R, 332

[56] References Cited

U.S. PATENT DOCUMENTS

| | | | |
|---|---|---|---|
| 1,143,981 | 6/1915 | Macklin | 128/70 |
| 3,870,038 | 3/1975 | Arblaster | 128/28 |
| 3,889,663 | 6/1975 | Fryer | 128/28 |

*Primary Examiner*—Robert C. Watson

*Attorney, Agent, or Firm*—Robert Henderson

[57] ABSTRACT

The cardiac patient support comprises a flat base board of a size suitable for supporting a human patient and having an overlying torso supporting board pivotally associated with a bottom end area of the base board and extending angularly upwardly in relation to the latter, a transversely extending roller being mounted upon the base board in engagement with the under side of the torso supporting board and having operating means associated with said eccentric roller for adjustably turning the latter to urge the upper end of the torso supporting board upwardly and to lock said eccentric roller in an adjusted turned position. A handle is disclosed for turning the eccentric roller and a ratchet and pawl assembly is disclosed for locking the eccentric roller in an adjusted, turned position.

1 Claim, 5 Drawing Figures

CARDIAC PATIENT SUPPORT

BACKGROUND AND OBJECTS OF THE INVENTION

Beneficial emergency treatment of cardiac patients calls for stimulation of the heart by suitably timed heart massage pressure and by suitably timed injection of air or oxygen into the patient's lungs, sometimes by mouth to mouth activity but, preferably, by pumping of air or oxygen into the patient's lungs. These steps, indeed most emergency remedial help to such patients, is best accomplished if the patient is positioned and restrained on his back upon a suitable cardiac board.

With reference to heart massage, the cardiac board and its components must be simple, yet strong enough to not only support the weight of the patient but to withstand added pressures imposed upon the patient during heart massage. Currently used cardiac boards, to meet this requirement, are both cumbersome and heavy; quite impractical for paramedic and ambulance emergency use.

With reference to introduction of air or oxygen into a patient's lungs, the patient's tongue, during an attack, often extends back in the mouth into a blocking position wherein it dangerously impedes the passage of air through the windpipe. This blocking condition must be effectively and quickly remedied before the introduction of air or oxygen and, thereafter during this treatment, the tongue must be caused to remain in a non-blocking condition.

The principal object of this invention is the provision of a cardiac board which elevates the torso of a patient while inducing his head to assume a lowered position relatively to his torso. In such a relation of the torso and head positions, the air passages through the mouth into the lungs become more or less straightened to ease the passage of air; and the tongue is easily brought forward to a non-blocking position in the mouth and caused to thus remain.

Other objects and advantages may be apparent from consideration of the present description and the accompanying drawings.

BRIEF DESCRIPTION OF THE DRAWINGS

FIG. 3 is a side elevational view of an eccentric roller employed in the patient support.

DETAILED DESCRIPTION OF THE INVENTION

My cardiac patient support comprises a flat, rigid, base board 10 disposed generally horizontally when in use, a rigid torso support board 12 pivoted at its lower end at opposite sides of the corresponding lower end of the base board as at pivot brackets 14. The torso support board 12 extends acute angularly above the base board 10 toward the latter's upper or head end, and the upper end of the torso support board terminates somewhat short of the base boards upper end in a transversely extending, downwardly curved upper terminus 16. The two boards just described are somewhat wider than the width of an adult patient's torso and arms and of such lengthwise dimensions as to correlate to the various dimensions of an adult patient as indicated in broken lines in FIG. 1.

Figure 2:
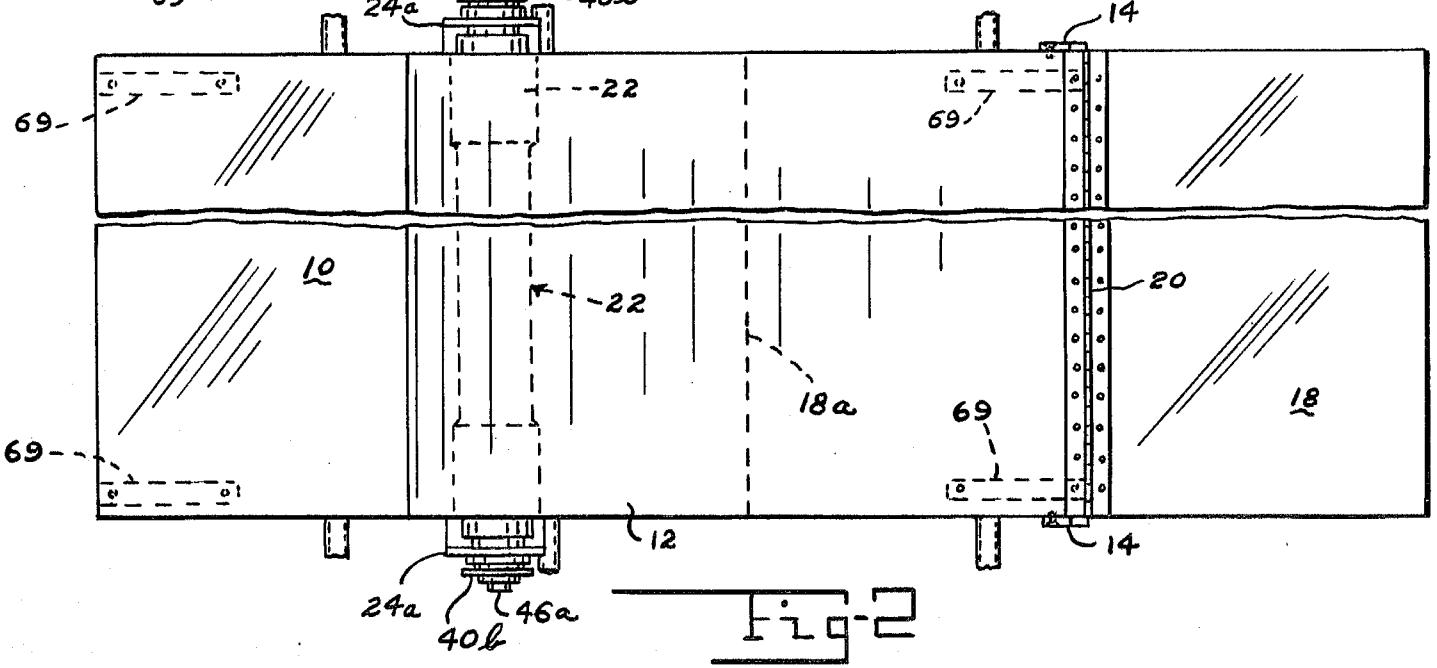
FIG. 2 is a top plan view of the patient support.
Figure 2:
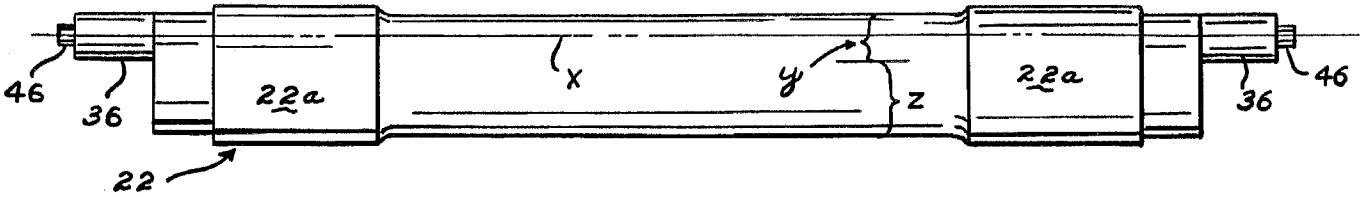

A flat, rigid, foot board 18 is pivoted at 20 to the lower end of the torso support board 12 to support the legs and feet of a patient. This foot board may be swung upwardly to lie intimately over the torso support board to the extent indicated by transverse broken line **18*a* (FIG. 2**), enabling the entire device to be shortened for storage or transportation.

An eccentric roller 22, shown alone in detail in FIG. 3, is operatively disposed transversely and horizontally under and in supporting engagement with the torso support board 12, adjacent to the latter's upper end. This eccentric roller is supported on the base board 10 and provided with operating means for turning it, all as hereinafter detailed. Said roller serves, when turned, to adjustably raise the upper end of the torso support board 12, whereby to raise the torso of a patient resting thereon.

Figure 5:
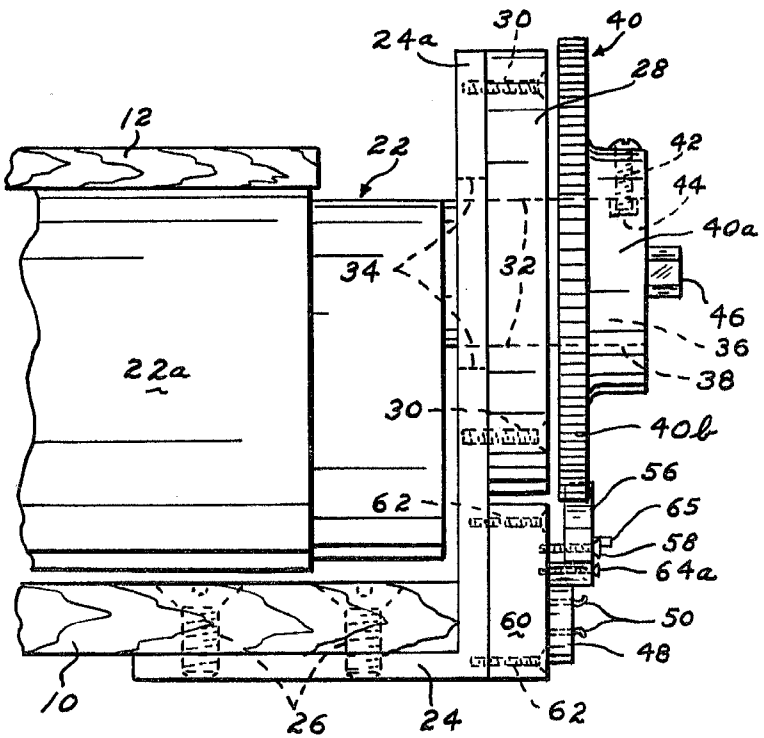
FIG. 5 is a similarly enlarged end elevational view of said roller operating means as seen from the left side of FIG. 4.

The eccentric roller 22, at both its ends, is similarly supported and adapted for operation; only one of the two similar ends being shown in FIG. 5. The roller 22 is supported by a rigid angle bracket 24, fixed to the base board 10 by screws 26 and is formed with an upright bearing flange **24*a*. A bearing block 28, preferably of suitable plastic material, is secured to the outer face of the flange 24*a* by screws 30. The bearing block 28 is formed with a circular bearing opening 32 and, concentrically therewith, the flange 24*a* is formed with a slightly larger circular opening 34**.

The eccentric roller 22 is formed with a projecting shaft portion 36 which, in the assembled patient support, projects freely through opening 34, thence, with a bearing fit, through bearing opening 32 and, thence further, with a tight fit, through a coaxial opening 38 of a ratchet wheel 40. The ratchet wheel is formed with an integral collar **40*a* into which a set screw 42 is radially threaded to project into a shallow radial bore 44 in shaft portion 36 of the eccentric roller to constrain the latter to turn with the ratchet wheel. Of various suitable means for turning the ratchet wheel 40, the shaft portion 36 of the eccentric roller is shown at its end as formed with an integral, hexagonal stud 46 to which a suitable wrench may be applied as a handle for manually turning the eccentric roller 22**.

In FIG. 3, the axis of rotation of the eccentric roller 22 is indicated by chain line X, the bracket Y indicates the concentric transverse area of said roller, and the bracket Z indicates the eccentric transverse area of said roller. The roller 22 is thickened toward its opposite ends by the provision of collars **22*a* fixed or formed there around. The collars 22*a* are the only parts of the roller which engage the overlying torso support board 12, thereby minimizing frictional opposition to the turning of said roller. These collars may be of suitable anti-friction material such as, for example, self lubricated metal or suitable plastic material. The remainder of the roller 22** should preferably be of aluminum to minimize weight.

Figure 4:
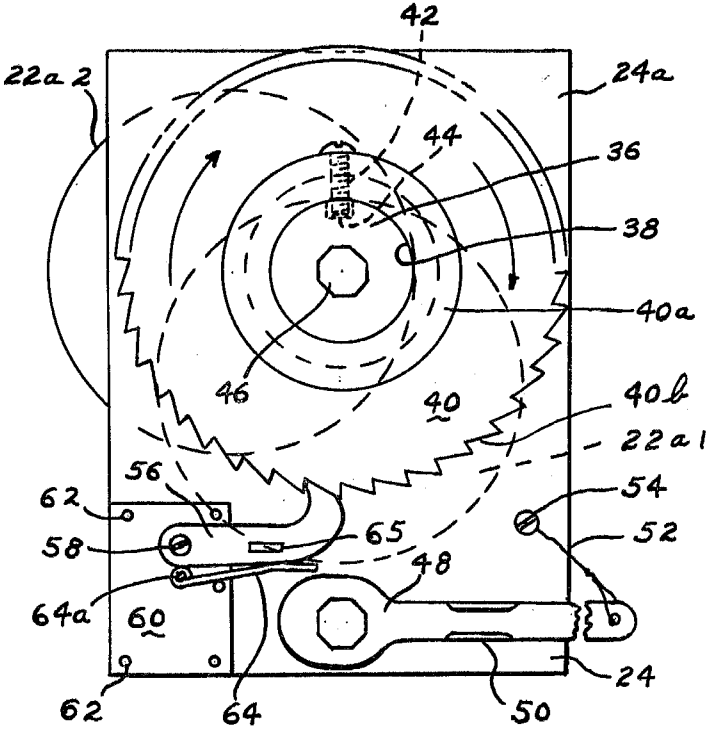
FIG. 4 is an enlarged end elevational view of eccentric roller operating means provided at an end of the eccentric roller for adjustably turning the latter and for holding the roller in an adjusted angular position.

In FIG. 4, which is approximately to full scale, broken line circles **22*a*1 and 22*a*2 indicate two 90° different angular positions of the eccentric collars 22***a* from which it should be evident that a quarter turn of the ratchet wheel 40 elevates the upper end of the torso support board 12 to the extent of about ¾ inches, the indicated arrangement making it possible to achieve elevation of said board to the extent of about 1½ inches, a degree of elevation which is adequate for the purposes of this invention. Obviously, some modification of the dimensions of the eccentric roller and/or of the ratchet wheel 40 may be effected if desired.

The ratchet wheel 40 is manually turned clockwisely to angularly elevate the torso support board 12, a suitable handle in the form of a hexagon box wrench 48 being provided for that purpose for use on the hexagon stud 46. Except when actually in use, the wrench 48 may be stored upon the angle bracket 24 by a snap retainer 50 suitably fixed to said bracket. The wrench may be captured against loss by a strong, flexible cable 52 or equivalent means connected between the wrench and a screw 54 on the bracket 24.

The ratchet wheel 40 and its related eccentric roller 22 are held by a pawl 56 against retraction from any adjusted position to which it has been turned. The pawl is pivoted at 58 upon a mounting block 60, fastened by screws 62 to the angle bracket 24 with the free end of the pawl so shaped and in such position as to interlock with teeth 40*b* of the ratchet wheel. The free end of the pawl 56 is spring biased toward and yieldably held in engagement with said teeth by a flat spring 64, suitably anchored at its one end 64*a* to the mounting block 60 with its other end 64*b* held yieldably against the bottom of the pawl. The pawl is formed with a side protuberance 65 serving as a fingering member, facilitating manual release of the pawl temporarily from engagement with the teeth 40*b* of the ratchet wheel to permit retractive readjustment of the ratchet wheel and its related eccentric roller 22.

The base board 10 is fitted with resilient straps 66, 67, and 68 (FIG. 1) provided respectively for restraining a patient's head, arms and torso as may become necessary. Alternatively, the straps 67 and 68 may be fitted upon the torso support board 12. The base board 10 is provided at the four corners of its under side with supports 69, spacing said board from the underlying floor or ground surface to provide space for paramedics, etc. to get their hands under said board to transport it with the patient thereon.

Figure 1:
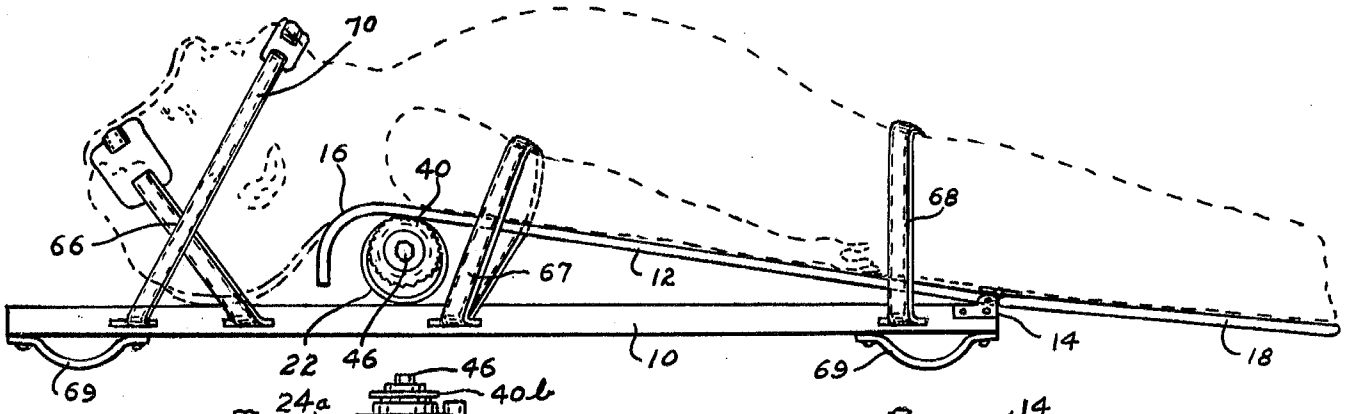
FIG. 1 is a side elevational view of a preferred embodiment of my patient support, including a broken line indication of a patient's body supported thereon.

Briefly summarizing the manner of using the subject cardiac patient support; the patient is placed on his back upon the device substantially as illustrated in FIG. 1, and straps 67 and 68 are applied and tightened if and to the extent necessary. At that point, the patient's head may be resting upon the base board 10 as indicated in the lowermost broken line representing the back of the patient's head. In that condition, the patient's head may not hang downwardly sufficiently in relation to his torso to enable his tongue to be brought and held forwardly in his mouth in a non-airblocking position.

To cause the patient's head to hand lower to facilitate unblocking of air to his lungs, the ratchet wheel 40 and the related eccentric roller 22 are manually turned clockwisely by wrench 48, thereby causing the eccentric roller to angularly raise the torso support board 12 and the patient's torso, causing the patient's head to assume a lower relation to his torso sufficient to permit the patient's tongue to be brought forward in his mouth and held thus in non-airblocking position. If necessary after thus raising the patient's torso, strap 66 may be applied to the patient's forehead and tightened only sufficiently to draw his head down to the necessary extent. Under some conditions, a suitably tensioned strap 70 may be applied to the patient's chin to assist in establishing and maintaining the free passage of air into the patient's lungs.

The materials selected for the parts of this patient support should be of the lightest kind consistent with the body supporting and operating stresses to which the device may be subjected. Thus, the board portions may be of light weight wood or of reinforced plastic material, and the metal parts may be of aluminum.

It should be apparent that the concepts disclosed herein may be availed of in various other ways without, however, departing from the invention as set forth in the following claims.

I claim:

1. In a cardiac patient support for adjusting the position of a patient's head relatively to its torso; the combination comprising a flat, rigid, horizontal base; a substantially flat, rigid, torso support of a length corresponding substantially to the length of an average human torso and of a width adjacent to its upper end corresponding substantially to the average shoulder width of a human torso, said torso support thereby being capable of directly supporting a patient's torso with the patient's head extending clear of the upper end of said support; a transversely extending hinge connecting the lower end of the torso support to said base toward the latter's lower end; and elevating means for raising and lowering the upper end of said torso support relatively to an underlying portion of said base; said elevating means comprising an eccentric roller extending substantially completely from side to side of said torso support, underneath and in supporting engagement with said torso support adjacent to the latter's upper end, bearings mounted on the base in supporting relation to opposite ends of said roller, and actuating means coacting with said bearings and roller to turn and hold the latter in various adjusted positions.

* * * * *